United States Patent [19]

Van Vliet et al.

[11] Patent Number: 5,039,912

[45] Date of Patent: Aug. 13, 1991

[54] HIGH-PRESSURE DISCHARGE LAMP

[75] Inventors: Johannes A. J. M. Van Vliet, Eindhoven, Netherlands; Willibrordus G. C. Verbeek, Turnhout, Belgium

[73] Assignee: U.S. Philips Corporation, New York, N.Y.

[21] Appl. No.: 570,093

[22] Filed: Aug. 20, 1990

[30] Foreign Application Priority Data

Sep. 8, 1989 [NL] Netherlands ..... 8902249

[51] Int. Cl.[5] ..... H01J 61/00; H01J 61/10

[52] U.S. Cl. ..... 313/25; 313/112; 313/634; 313/635

[58] Field of Search ..... 313/25, 112, 634, 635

[56] References Cited

U.S. PATENT DOCUMENTS 4,281,274 7/1981 Bechard et al. ..... 315/49

4,916,353 4/1990 Danko et al. ..... 315/25

FOREIGN PATENT DOCUMENTS 8502966 10/1985 Netherlands .

*Primary Examiner*—Donald J. Yusko

*Assistant Examiner*—N. D. Patel

*Attorney, Agent, or Firm*—Brian J. Wieghaus

[57] ABSTRACT

The high-pressure discharge lamp has around the discharge vessel an inner sheath of quartz glass and an outer sheath of aluminosilicate glass. An interference filter reflecting UV radiation is present between the discharge vessel and the outer sheath. The light emitted by the lamp thus satisfies the conventional standards regarding radiation for lamps operated in open luminaires.

6 Claims, 2 Drawing Sheets

HIGH-PRESSURE DISCHARGE LAMP

BACKGROUND OF THE INVENTION

The invention relates to a high-pressure discharge lamp having a discharge device which is energizable for emitting visible light and ultraviolet radiation and which is surrounded within a light transmissive outer envelope by an inner and outer glass sheath.

Such a lamp is described in the prior Pat. Application No. NL 8900216, light which corresponds to U.S. application Ser. No. 458,112 filed Dec. 28, 1989. The glass sheaths are cylindrical and have their adjacent ends closed by a respective metal plate Here the glass sheaths serve to protect the environment of the lamp from the consequences of an explosion of the discharge device, which may occur at the end of the life of the lamp. The lamp is designed so that fragments of the discharge device and a glass sheath remain in the outer envelope due to the fact that the latter remains undamaged.

On discharge lamps of the said kind, which have a transparent outer envelope, i.e. an outer envelope not coated with powder, and which are intended to be operated in open luminaires, the requirement is imposed that they produce radiation which is not harmful for people and materials. Standards then hold with respect to:

the damage factor (Fd), which must be smaller than 0.25, where:

$$Fd = Cd \frac{\int P(\lambda) \cdot D(\lambda) \cdot d\lambda}{\int P(\lambda) \cdot V(\lambda) d\lambda}$$

Herein, Cd=a constant; P(λ)=the spectral power distribution; V(λ)=the eye sensitivity curve and D(λ)=the relative spectral damage function described by National Bureau of Standards (see Lighting Res. Techn. 20(2), 43–53, 1988)).

the admissible irradiation time (PET), which for a 70 W lamp with an illumination intensity of 1000 lx must be larger than 16 hr (Nat. Inst. for Occupational Safety and Health), where $$PET = Cp \frac{\int P(\lambda) \cdot V(\lambda) d\lambda}{\int P(\lambda) \cdot S(\lambda) \cdot d\lambda} \text{ (hr)}$$

Herein Cp=a constant, P(λ) and V(λ) have the aforementioned meanings and S(λ)=a function describing the relative effect of radiation on skin and eyes.

The emitted UV-A power (P UV-A), which must be smaller than 0.55 W.

NL 8502966-A ) discloses a discharge lamp, in which the discharge is surrounded by an interference filter in that the lamp vessel (or discharge device) is covered with such a filter. However, the lamp emits a substantial quantity of UV-A radiation and also transmits UV-B and UV-C radiation Therefore, the lamp is intended to be used in a closed luminaire.

U.S. Pat. No. 4,281,274-A discloses a discharge lamp, which has around the lamp vessel (or discharge device) an open tube of borosilicate glass, which has a positive potential with respect to the lamp vessel. The tube of borosilicate glass, which would be opaque to UV radiation, must prevent that due to this radiation electrons are detached from metal parts of the lamp. Such electrons can be deposited on the lamp vessel and can give rise to loss of sodium from its filling. Nevertheless a positive potential is applied to the tube to collect and hold detached electrons.

SUMMARY OF THE INVENTION

The invention has for its object to provide a lamp of the kind described in the opening paragraph, which satisfies the said safety standards with respect to UV radiation.

According to the invention, this object is achieved in that the glass of the inner sheath has an $SiO_2$ content of at least 96% by weight, the outer sheath consists of aluminosilicate glass, and the lamp vessel is surrounded by an interference filter reflecting UV radiation.

For the inner sheath, use may be made, for example, of quartz glass or of a glass bearing a great resemblance thereto having the indicated high $SiO_2$ content by weight, such as, for example, Vycor. The inner sheath has a high thermal resistance and constitutes a thermal resistor, which keeps the outer sheath at a comparatively low temperature of, for example, at most 700° C.

Together with the interference filter, the outer sheath shields the environment of the lamp effectively from the UV radiation generated by the discharge in the lamp vessel. It is favourable for the radiation load of the outer sheath when the interference filter is located between said sheath and the lamp vessel.

In a favourable embodiment, the interference filter is carried by the inner sheath, more particularly by its inner surface. The filter may then be applied rapidly and readily, for example by vapour deposition or CVD at a low pressure.

BRIEF DESCRIPTION OF THE DRAWINGS

An embodiment of the lamp according to the invention is shown in the drawing. In the drawing.

DESCRIPTION OF THE PREFERRED EMBODIMENTS

Figure 1:
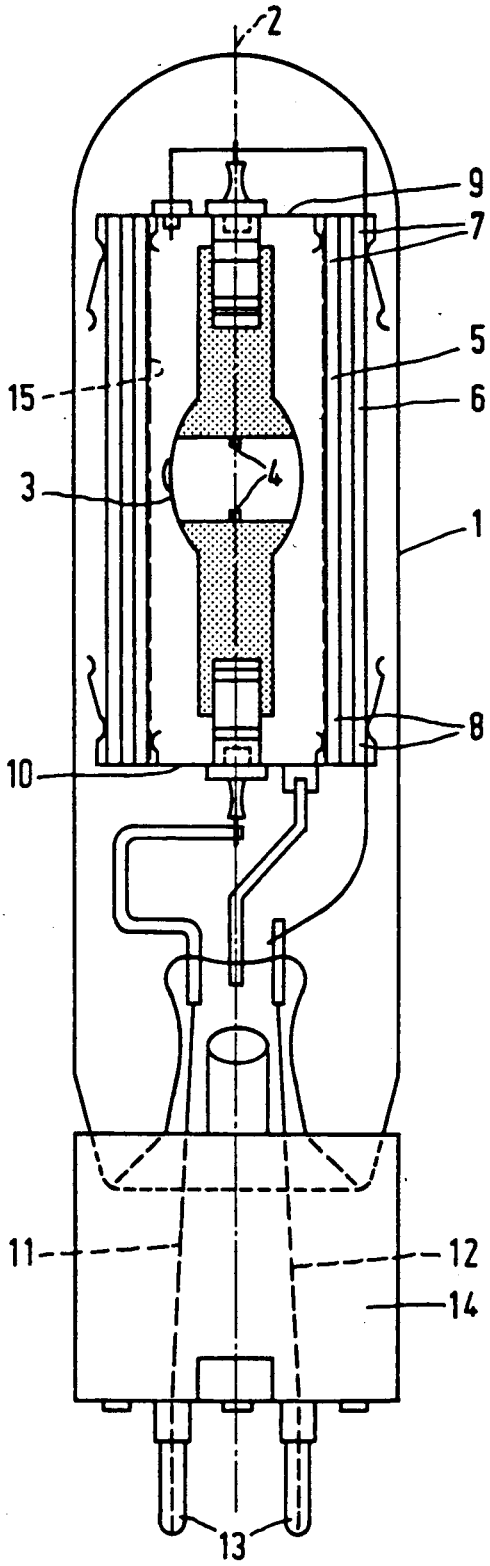
FIG. 1 is a side elevation of a lamp.

In FIG. 1, the high-pressure discharge lamp has a transparent outer envelope 1 with an axis 2, in which a discharge device having a a quartz glass discharge vessel 3 provided with a pair of electrodes 4 and an ionizable filling is axially arranged.

The outer sheath 1 arranged to surround the discharge device 3 accommodates an inner glass sheath 5 and an outer glass sheath 6 having first and second ends 7 and 8, respectively, which are closed by a metal plate 9 and 10, respectively.

Current supply conductors 11, 12 extend from outside the outer envelope in a vacuum-tight manner to the pair of electrodes 4. Application of a potential across the conductors 11, 12 energizes the discharge device to emit visible light and also ultraviolet radiation.

The discharge device has a filling of, for example, 13 mg of Hg, 2.4 mg of salt consisting of an iodide of thulium, holmium, dysprosium, sodium and thorium and 100 mbar of Ar/Kr and has a colour temperature of 4000 K and is adapted to consume a power of 70 W.

The inner sheath 5 consists of glass having an $SiO_2$ content of at least 96% by weight, for example of quartz glass, while the outer sheath 6 consists of aluminosilicate glass, for example of glass having 58.8% by weight of $SiO_2$, 17.2% by weight of $Al_2O_3$, 4.6% by weight of $B_2O_3$, 8.0% by weight of MgO, 11.3% by weight of CaO, 0.1% by weight of ($Fe_2O_3$, $TiO_2$, $ZrO_2$).

The discharge device 3 is surrounded by an interference filter 15 reflecting UV radiation. In the Figures, this filter is carried by the inner sheath 5, i.e. at its inner surface.

The filter may be composed, for example, of alternating layers of $SiO_2$ having a comparatively low refractive index and $Si_3N_4$ having a comparatively high refractive index. The filter may have outer layers of 22.19 nm $Si_3N_4$, which are adjoined by $SiO_2$ layers of 60.75 nm in alternation with $Si_3N_4$ layers of 44.38 nm, for example 7 $Si_3N_4$ layers and 6 $SiO_2$ layers in all.

The UV properties of the lamp are indicated together with the standard values in Table 1.

TABLE 1

| | Lamp | Norm |
|---|---|---|
| Fd | 0.19 | <0.25 |
| PET (hrs)* | 33 | >16 |
| UV-A (W) | 0.42 | <0.55 |

*at 1000 lx

It appears from Table 1 that the lamp offers effective protection against UV radiation produced by the discharge.

Figure 2:
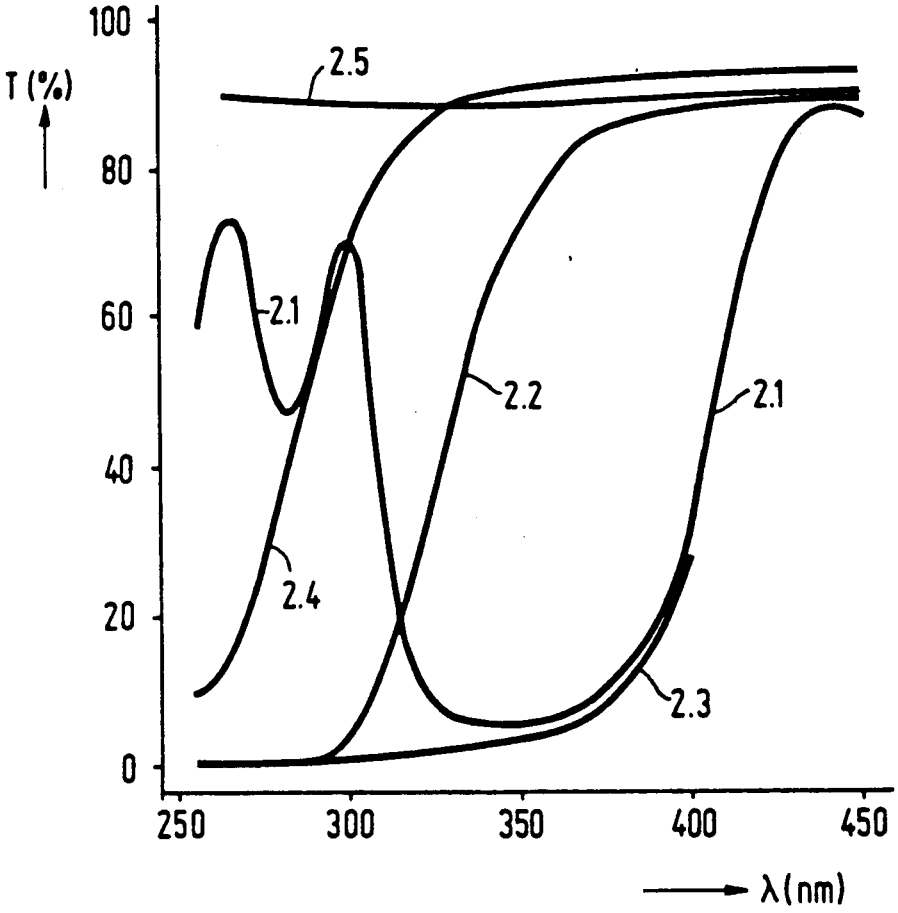
FIG. 2 shows a graph of UV transmission properties inter alia of the interference filter.

In FIG. 2, the curve 2.1 indicates the transmission of the interference filter used in the lamp of FIG. 1 as a function of the wavelength. It appears from the Figures that in a range below 320 nm much UV radiation is transmitted.

The curve 2.2 indicates the transmission of aluminosilicate glass as a function of the wavelength at 25° C. At wavelengths above 300 nm, the glass transmits much radiation. At higher temperatures, the curve shifts to greater wavelengths. At a temperature of 700° C., the point of 50% transmission lies at 360 nm instead of at 330 nm, as in the Figure.

The curve 2.3 indicates the transmission of the combination of the interference filter and the aluminosilicate glass as a function of the wavelength at 25° C.

The curve 2.4 indicates the transmission of borosilicate glass as a function of the wavelength.

It appears from the Figures that borosilicate glass transmits much more short-wave UV radiation than aluminosilicate glass and is not suitable for the object aimed at even in combination with an interference filter.

The curve 2.5 indicates the transmission of quartz glass as a function of the wavelength. The curve shows that quartz glass transmits very much UV radiation.

We claim:

1. A high pressure discharge lamp having a transparent outer envelope defining a lamp axis, a discharge device arranged axially within said outer envelope and comprising a quartz glass discharge vessel, an ionizable filling, and a pair of discharge electrodes between which a discharge is maintained during lamp operation, an inner and an outer glass sheath surrounding said discharge device and having first and second adjacent open ends, a pair of plates closing said first and second open sheath ends, and current supply conductors extending through said outer envelope to said discharge electrodes for energizing said discharge device to emit visible light and ultraviolet radiation, characterized in that:

said inner glass sheath having an $SiO_2$ content of at least 96% by weight, said outer sheath consisting of aluminosilicate glass, and an interference filter within said outer envelope surrounding said discharge device and reflecting UV radiation toward said discharge device.

2. A high pressure discharge lamp according to claim 1, wherein said interference filter is disposed between said outer sheath and said discharge device.

3. A high-pressure discharge lamp as claimed in claim 2, characterized in that the interference filter is carried by the inner sheath.

4. In a high pressure discharge lamp having a transparent outer envelope, a discharge device arranged within said outer envelope and energizable for emitting visible light and UV radiation, and containment means for containing discharge device fragments in the event of explosive failure of said discharge device, said containment means comprising an inner and an outer glass sheath surrounding said discharge device, improvement comprising:

said inner glass sheath having an $SiO_2$ content of at least 96% by weight, said outer sheath consisting of aluminosilicate glass, and an interference filter within said outer envelope surrounding said discharge device and reflecting UV radiation.

5. In a high pressure discharge lamp according to claim 4, wherein said interference filter is disposed between said outer sheath and said discharge device.

6. In a high pressure discharge device according to claim 5, wherein said interference filter is disposed on said inner sheath.

* * * * *